US005193676A

United States Patent [19]

Gold

[11] Patent Number: 5,193,676

[45] Date of Patent: Mar. 16, 1993

[54] PACKAGING SYSTEM

[76] Inventor: Danny Gold, 27 Barker Road, Apt E-2, Hong Kong, Hong Kong

[21] Appl. No.: 739,085

[22] Filed: Aug. 1, 1991

[51] Int. Cl.[5] ..... B65D 73/00; B65D 85/18

[52] U.S. Cl. ..... 206/296; 40/664; 206/292; 206/495; 206/806; 211/113

[58] Field of Search ..... 40/662–665, 40/667, 668; 206/278, 292, 477–483, 493, 495, 526, 806, 296; 211/57.1, 59.1, 113; 248/317, 340

[56] References Cited

U.S. PATENT DOCUMENTS

| | | | |
|---|---|---|---|
| 1,785,988 | 12/1930 | Sutcliffe | 206/806 |
| 2,995,845 | 8/1961 | Fraser | 206/278 |
| 3,037,621 | 6/1962 | Jackman | 206/296 |
| 3,297,290 | 1/1967 | Patterson | 211/59.1 |
| 3,402,435 | 9/1968 | Merser | 40/668 |
| 4,143,772 | 3/1979 | Bona | 206/493 |
| 4,189,049 | 2/1980 | Silver | 206/493 |
| 4,537,310 | 8/1985 | Thul | 206/526 |
| 5,014,957 | 5/1991 | Nichol, Jr. | 206/806 |

FOREIGN PATENT DOCUMENTS

| | | | |
|---|---|---|---|
| 0093988 | 11/1983 | European Pat. Off. | 206/493 |
| 0400782 | 4/1966 | Switzerland | 206/806 |

*Primary Examiner*—Jimmy G. Foster
*Attorney, Agent, or Firm*—Aufrichtig Stein & Aufrichtig

[57] ABSTRACT

A packaging system for displaying merchandise on a rack system having a rack member. At least two pieces of merchandise are intended to be displayed together on the rack system. Each of the pieces of merchandise has a reinforcing member secured in the merchandise to provide at least one reinforced opening through each piece of the merchandise. A coupling mechanism extends through the reinforced opening in each piece of merchandise securing the pieces of merchandise to each other and supports the pieces of merchandise on the rack member. The at least two pieces of merchandise can be displayed on the rack system by hanging the coupling mechanism on the rack member and the at least two pieces of merchandise can be removed from the rack member and inspected and tested without affecting the attachment of the pieces of merchandise to each other. In addition, a support or header member with at least one reinforced opening can be coupled by the coupling mechanism to the at least two pieces of merchandise so that the pieces of merchandise may be secured to the header member and the header member may be secured to the rack.

25 Claims, 3 Drawing Sheets

PACKAGING SYSTEM

BACKGROUND OF THE INVENTION

The invention is generally directed to a packaging system and in particular to a packaging system for displaying items on a rack system of a type common to self-service marketing and even more particularly to an improved packaging system for securing a header card to items which are intended to be displayed in pairs on a rack system.

Rack systems provide a useful and convenient method for presenting and displaying merchandise for sale. They can be provided, for example, on countertops, as wall mounted units or as floor mounted units in order to achieve optimum utilization of available space.

Many different types of merchandise can be displayed on rack systems. Among the types of merchandise commonly displayed are wearing apparel such as gloves, mittens, hats, ski masks, scarves, socks and the like.

In the case of wearing apparel, it is desirable for a consumer be able to try on and inspect the merchandise prior to making a purchase. Direct contact and the availability to try on the article will often encourage a consumer to make a purchase, especially an impulse purchase, if the merchandise is properly sized and well constructed.

One of the difficulties that arises in the case of merchandise displayed on rack systems is that handling the merchandise is often inconvenient and unwieldy as a result of the manner in which the merchandise is packaged. For example, one common method of displaying merchandise on rack systems is to package the merchandise in plastic bags. Such bags are often heat sealed, thereby making it impossible to inspect the merchandise without opening the bag. Since bags of this type are not presentable for sale once they have been opened, opening the bags is generally not encouraged. From the retailer's perspective, however, they cannot actively prevent the customers from trying on the merchandise to locate the appropriate size or check the fit. Unfortunately, this results in loose and mixed up pairs.

In an effort to overcome this dilemma, plastic bags with openable closures have been introduced. These bags permit the merchandise to be replaced into the bags and resealed without rendering the bags and enclosed merchandise unsuitable for sale. However, this leads to further problems in that consumers often fail to replace the merchandise. Consequently, the area surrounding the rack system becomes messy and unattractive. Furthermore, merchandise that is typically sold in pairs such as gloves, mittens, socks and other items are often separated when removed from the bags.

In addition, plastic bags cause environmental damage both in their manufacture and in their disposal. Such environmentally damaging packaging is rapidly becoming unacceptable in view of today's increased environmental awareness.

Another approach that is commonly used is the attachment of gloves, socks or other small articles with plastic tag attachers which keep the pair of gloves or socks together under display conditions. However, either the customers are unable to try on the gloves or socks because the plastic tag prevents this or the customer rips the plastic tag and, if the customer doesn't buy the gloves or socks, the gloves or socks are then loose and can be difficult to match back into pairs.

Accordingly, there is a need for an improved packaging system for displaying paired merchandise on rack systems so as to provide a neat and attractive display while still permitting the merchandise to be tried on and inspected.

SUMMARY OF THE INVENTION

The invention is generally directed to a packaging system for displaying merchandise on a rack system. At least one reinforcing member is secured in at least two items of merchandise to be displayed and has an opening therethrough to provide at least one reinforced opening through each of the items merchandise. A merchandise securing member is coupled to the merchandise through the reinforced openings on each item. The merchandise securing member includes a hook portion that extends through the reinforced opening and forms a closed loop to couple the merchandise to the merchandise securing member and a hanging portion for hanging the merchandise on a rack system. As a result, the merchandise can be displayed on a rack, removed for inspection and readily replaced on the rack.

The invention is also directed to a packaging system for displaying merchandise on a rack system using a header member. A reinforcing member is secured in the merchandise to be displayed and has an opening therethrough to provide a reinforced opening through the merchandise. A bracing member is affixed to header member and has a hole therethrough to provide a braced hole through the header member. A merchandise securing member extends through the reinforced opening in the merchandise and through the braced hole in the header member and forms a closed loop in order to couple the at least two items of merchandise to itself and to the header member. As a result, the merchandise is firmly coupled to the header member and can be displayed on a rack system. When the merchandise and header member are removed from the rack, the merchandise can be tried on and inspected without affecting the attachment of the merchandise to the header card. Following inspection, the merchandise and header card can be readily replaced on the rack.

Accordingly, it is an object of the invention to provide an improved packaging system for displaying merchandise on a rack system.

Another object of the invention is to provide an improved packaging system that permits paired merchandise to be tried on prior to sale without producing loose merchandise.

A further object of the invention is to provide an improved packaging system that permits paired merchandise to be inspected and tried on prior to sale.

Still another object of the invention is to provide an improved packaging system that permits paired merchandise to be easily returned to a rack in paired form after it has been tried on or inspected.

Still another object of the invention is to provide an improved packaging system that minimizes the amount of disarray surrounding a rack display with which the packaging system is used.

Still a further object of the invention is to provide an improved packaging system that permits paired merchandise to be secured to a header card.

Yet another object of the invention is to provide an improved packaging system that permits paired merchandise to be coupled together so that it may be tried on without affecting the coupling.

Yet a further object of the invention is to provide an improved packaging system that causes a minimum of environmental damage.

Even another object of the invention is to provide an improved packaging system that can be incorporated as a design feature in the merchandise being packaged.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
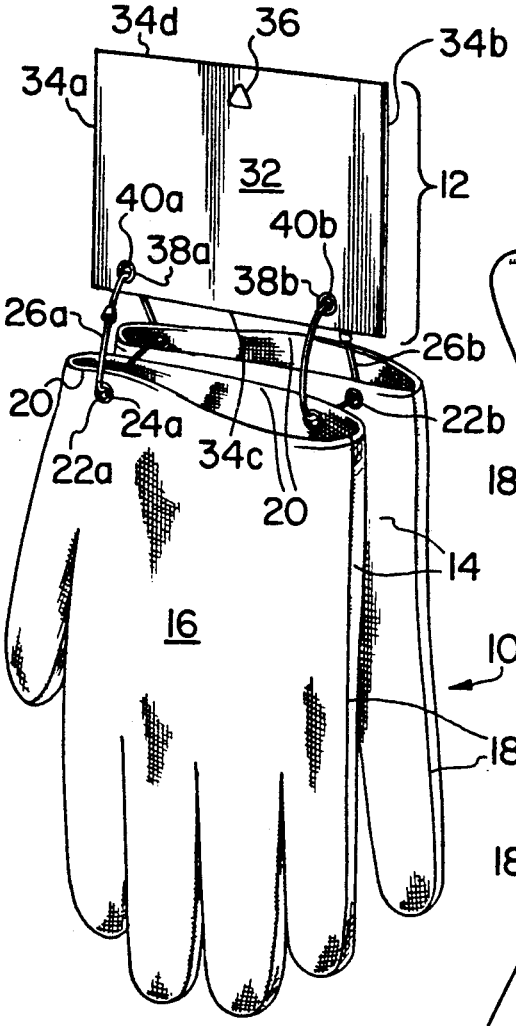
FIG. 1 is a perspective view of a packaging system constructed and arranged in accordance with an preferred embodiment of the invention used to package a pair of gloves.
Figure 2:
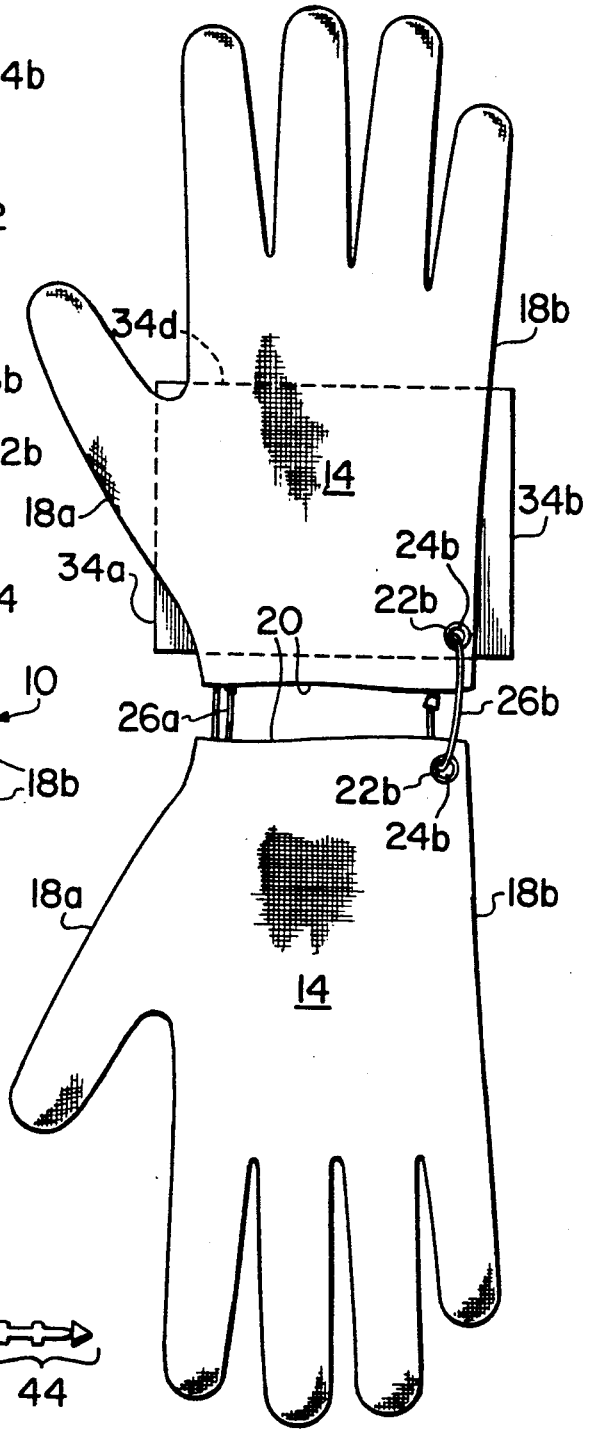
FIG. 2 is a plan view showing the flexibility of the packaging system of FIG. 1.

Reference is first made to FIGS. 1 and 2 wherein a pair of gloves, generally indicated as 10, utilizing a packaging system generally indicated as 12, constructed in accordance with a preferred embodiment of the invention are depicted.

The merchandise or gloves 10 includes palm portions 14 and back portions 16 joined along side seams 18*a* and 18*b*. A lower glove edge 20 extends along palm portion 14 and back portion 16 and defines an opening through which a hand can be inserted into glove 10.

Packaging system 12 includes two reinforcing members or first and second grommets 22*a* and 22*b* secured in palm portion 14 of each glove 10 so as to form first and second reinforced openings 24*a* and 24*b*. Grommets 22*a* and 22*b* are positioned in proximity to top glove edge 20. In addition first grommet 22*a* is positioned in proximity to side seam 18*a* and second grommet 22*b* is positioned in proximity to side seam 18*b*. Accordingly, grommets 22*a* and 22*b* are in a position where they do not interfere with the flexibility of gloves 10 or the ability of a customer to try on and then remove glove 10 from a hand.

Packaging system 12 also includes a header card 32. Header card 32 can be any type of sturdy material or stiffened cardboard as is common in the industry for providing an identifying label on glove 10. In general, header card 32 would include an attractive display as it is an important feature for catching the eye of a consumer at the point of sale. Header card 32 has an outer edge and, as shown specifically in FIGS. 1 and 2, the outer edge includes first and second side edges 34*a* and 34*b*, a lower edge 34*c* proximate nearer glove 10 and an upper edge 34*d* proximate further glove 10.

A rack accommodating opening 36 is provided in header card 32 for mounting header card 32 on a rack system. Rack accommodating opening 36 is generally provided proximal upper edge 34*d* and substantially equidistant each of first and second side edges 34*a* and 34*b*. In the embodiment shown, the rack accommodating opening 36 is substantially triangular in shape with rounded corners and this shape is useful for mounting header card 32 on peg board type rack systems and the like. In addition, a slip-on hole in the top of header card 32 in the shape of an upside down "7" can be used to attach header card 32 to a rack system. Likewise, a hook member can be added to header card 32, preferably at the top for attaching header card 32 to the rack system.

Header card 32 further includes first and second bracing members 38*a* and 38*b* positioned substantially adjacent lower edge 34*c* of header card 32. These eyelets or grommets 38*a*, 38*b* are preferably formed of a metal or hard plastic material which is sufficiently strong and resistant to stretching or ripping as to provide a stable base for connecting header card 32 to gloves 10. First eyelet 38*a* is proximate first side edge 34*a* and second eyelet 38*b* is proximate second side edge 34*b*. Consequently, eyelets 38*a* and 38*b* form braced holes 40*a* and 40*b* respectively, in header card 32. Where the header material is sufficiently strong no reinforcing grommet or eyelet is necessary although for additional safety it may still be included.

Figure 3:
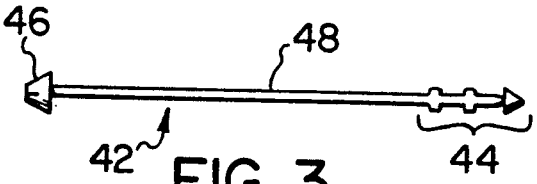
FIG. 3 is a plan view of a linear closure used to form a portion of the packaging system of FIGS. 1 and 2.

Packaging system 12 also further includes first and second merchandise coupling members 26*a* and 26*b*. Each merchandise coupling member 26*a* and 26*b* is formed from a linear closure 42 of the type shown in FIG. 3. Linear closure 42 includes an insertable mechanism 44 at one end thereof and a receiving mechanism 46 at the opposite end thereof. A joining portion 48 joins insertable mechanism 44 and receiving mechanism 46. Other types of lining closures or rig closures which are known, maybe used in place of the linear closure 42.

To form first merchandise securing member 26*a* in accordance with the invention, one end of linear closure 42 is threaded through first reinforced opening 24*a* in each of the pair of gloves 10 and through first braced opening 40*a* in header card 32. Linear closure 42 is then closed by inserting insertable mechanism 44 into receiving mechanism 46 so that joining portion 48 forms a loop. Second merchandise securing member 26*b* is formed in a similar fashion using second reinforced opening 24*b* in each of the pair of gloves 10 and second braced hole 40*b* in header card 32. Since insertable mechanism 44 and receiving mechanism 46 form a one way ratchet type mechanism, gloves 10 are firmly affixed to header card 32 or the other glove 10.

It will be appreciated that the integrity of packaging system 12 is dependent largely on the integrity of linear closure 42 used to form merchandise securing members 26*a* and 26*b*. In general, linear closures 42 will be formed of a plastic material such as polyethylene, polypropylene, polyethylene terephthalate, nylon and the like. For environmental reasons other linear closures 42 such as string or cord may be used. The physical characteristics such as strength of the material determine the thickness of linear closure 42 that is required.

It will also be appreciated that the maximum distance between glove 10 and header card 32 is approximately one half the length of joining portion 48. This distance should be short enough to optimize the use of space on the rack system display while, at the same time, long enough to permit a hand to be inserted into glove 10 through the opening defined by lower glove edge 20 without interference from header card 32 or the other glove 10.

Accordingly, the packaging system 12 provided in accordance with the invention securely packages gloves 10 on a header card 32 for display on a rack system while still permitting gloves 10 to be removed from the rack, tried on and inspected, assures that glove 10 may conveniently returned to the rack as a single unit. The merchandise or gloves 10 can only be removed from header card 32 upon the application of force to the merchandise securing members 26*a* and 26 such as would be applied by destructive pulling, a scissor, razor or the like.

Figure 4:
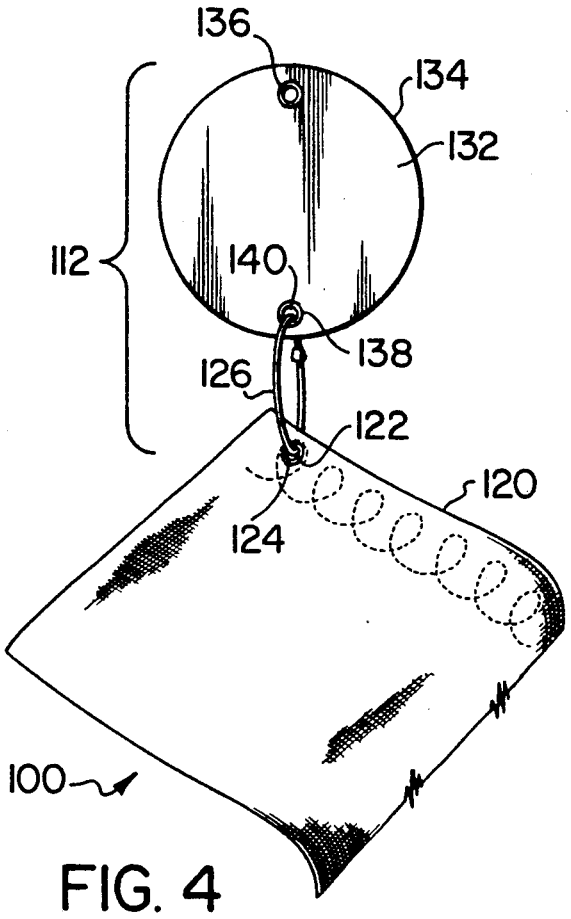
FIG. 4 is a plan view of a packaging system constructed and arranged in accordance with another preferred embodiment of the invention used to package a scarf.

Reference is next made to FIG. 4 wherein a scarf, generally referred to as 100, incorporating a packaging system generally referred to as 112 constructed in accordance with another embodiment of the invention is depicted.

Scarf 100 includes an edge 120 and may have a pattern or design on one or both sides thereof for decorative purposes.

Packaging system 112 includes a reinforcing member or grommet 122 secured in scarf 100 to form a reinforced opening 124. The positioning of grommet 122 is in proximity to scarf edge 120 and, when scarf 100 has a pattern or design, grommet 122 may be positioned so as to be incorporated into the pattern or design.

Packaging system 112 further includes a header card 132 of the type described in connection with FIGS. 1 and 2. Header card 132 is shown as round to illustrate that the shape of the header card used in connection with the packaging system of the invention is not critical and that the header card may be any size and shape desired.

Header card 132 includes a rack accommodating opening 136 of the type described hereinabove. Rack accommodating opening is also shown as round to illustrate the flexibility available in choosing the shape of the rack accommodating opening. The size of the rack accommodating opening is limited only by the requirement that the opening permit the card to be mounted on a rack system.

A bracing member 138 is positioned in header card 132 substantially adjacent an edge 134 to form a braced hole 140. Again, the positioning of bracing member 138 is not intended to limit the packaging system of the invention and is selected primarily by design considerations.

A merchandise securing member 126 extends through reinforced opening 124 in scarf 100 and through braced hole 140 in header card 132 and forms a closed loop. Since merchandise securing member 126 is formed from a one way closure, scarf 100 is firmly affixed to header card 132 for display on a rack system. Scarf 100 can be removed from header card 132 by the application of force to merchandise securing member 126.

Figure 5:
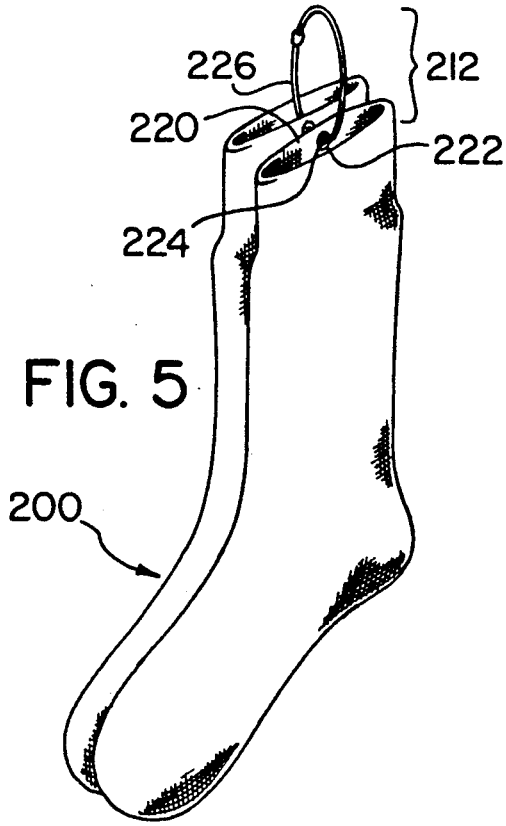
FIG. 5 is a perspective view of a packaging system constructed and arranged in accordance with another embodiment of the invention used to package a pair of socks.

Reference is next made to FIG. 5 wherein a pair of socks, generally referred to as 200, incorporating a packaging system generally referred to as 212 constructed in accordance with another embodiment of the invention is depicted.

Socks 200 each include a reinforcing member or grommet 222 secured along an upper sock edge 220 through which a foot is inserted and forms a reinforced opening 224 in each sock 200. A merchandise securing member 226 is positioned in reinforced opening 224 and forms a closed loop using a one way closure mechanism. As a result, socks 200 are firmly secured together and can be displayed on a rack system by hanging merchandise securing member 226 directly on the rack. Socks 200 can be removed from the rack, inspected and conveniently returned to the rack without disturbing packaging system 212. After purchase, merchandise securing member 226 can be removed by the application of force and reinforcing members 222 are incorporated as a design feature or air holes in socks 200.

Figure 6:
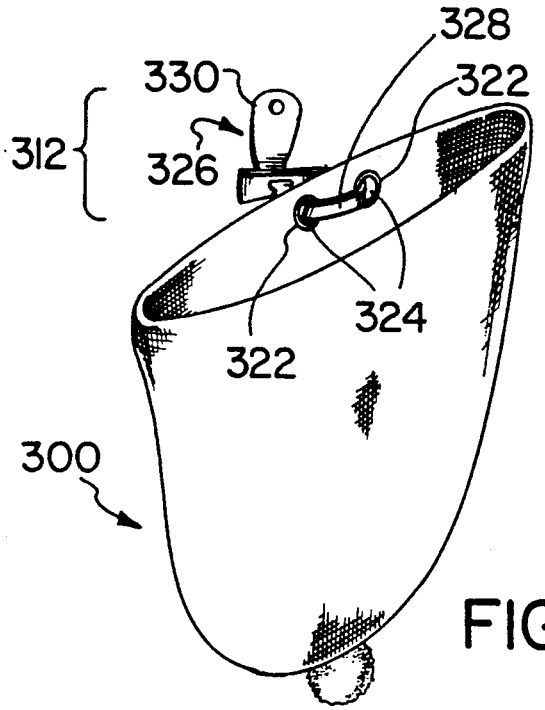
FIG. 6 is a perspective view of a packaging system constructed and arranged in accordance with another embodiment of the invention used to package a hat; and, FIG. 7 is a plan view of a linear closure used to form a merchandise securing member in the packaging system of FIG. 6.
Figure 7:
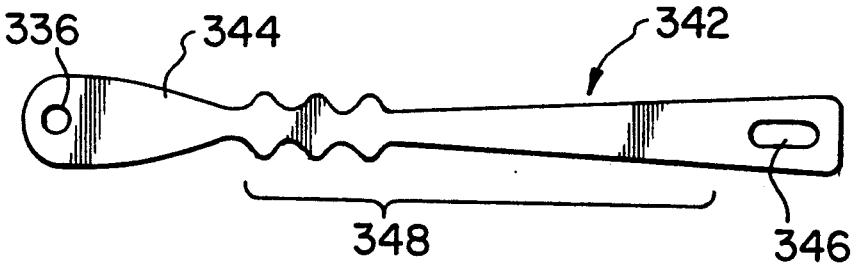

Reference is next made to FIGS. 6 and 7 wherein a hat, generally indicated as 300, incorporating a packaging system generally indicated as 312, constructed in accordance with another preferred embodiment of the invention is depicted.

Packaging system 312 includes two reinforcing members or grommets 322 secured in hat 300 to form two reinforced openings 324. A merchandise securing member 326 is secured through each of reinforced openings 324 as an illustration that it is not necessary to position the merchandise securing members around an edge of the merchandise or item being packaged. A closed loop is formed by merchandise securing member 326 in order to firmly secure merchandise securing member 326 to hat 300.

In this embodiment, merchandise securing member 326 is formed from a linear closure 342 of a type shown in FIG. 7. Linear closure 342 includes an insertable mechanism 344 including a rack accommodating opening at one end thereof and a receiving mechanism 346 at the opposite end thereof. A joining portion 348 joins insertable mechanism 344 and receiving mechanism 346.

To form merchandise securing member 326 in accordance with the invention, one end of linear closure 342 is threaded through each reinforced opening 324 in hat 300. Linear closure 342 is then closed by inserting insertable mechanism 344 into receiving mechanism 346 so that joining portion 348 forms a loop. In this case, the loop is smaller than half the length of joining portion 348 and the merchandise securing member is adapted to be hung on a rack using rack accommodating opening 336. Consequently, each merchandise securing member 326 has a hook portion 328 for hooking the merchandise securing member 326 to the merchandise or hat 300 and a hanging portion 330 for hanging the merchandise securing member 326 on a rack system. As a result, hat 300 can be efficiently secured on a rack using a packaging system provided in accordance with the invention.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It will also be understood that the following claims are intended to cover all of the generic and specific features of the invention herein described and all statements of the scope of the invention which, as a matter of language, might be said to fall therebetween.

What is claimed is:

1. A packaging system for displaying merchandise on a rack system having a rack member, comprising:

at least two pieces of merchandise for display together on the rack system;

reinforcing means secured in each of the at least two pieces of merchandise and adapted to provide at least one reinforced opening through each piece of the merchandise;

coupling means extending through the reinforced opening in each piece of merchandise, for securing the pieces of merchandise to each other and supporting all of the pieces of merchandise below the rack member;

whereby the at least two pieces of merchandise can be displayed on the rack system by hanging the coupling means on the rack member and the at least two pieces of merchandise can be removed from the rack member and inspected and tested without affecting the attachment of the pieces of merchandise to each other.

2. The packaging system of claim 1 wherein the reinforcing means is a grommet.

3. The packaging system of claim 2 wherein the grommet is formed of metal.

4. The packaging system of claim wherein the merchandise being packaged has an edge and wherein the reinforcing means is positioned proximate to the edge.

5. The packaging system of claim 1 wherein the coupling means is formed of a plastic material.

6. The packaging system of claim 1 wherein the reinforcing means provides two reinforced openings through each piece of merchandise.

7. A packaging system for displaying merchandise on a rack system having a rack member, comprising:

at least two pieces of merchandise for display together on the rack system;

reinforcing means secured in each of the at least two pieces of merchandise and adapted to provide at least one reinforced opening through each piece of the merchandise;

coupling means extending through the reinforced opening in each piece of merchandise, for securing the pieces of merchandise to each other and supporting the pieces of merchandise on the rack member wherein the coupling means is formed from a linear closure that is closed to form a closed loop;

whereby the at least two pieces of merchandise can be displayed on the rack system by hanging the coupling means on the rack member and the at least two pieces of merchandise can be removed from the rack member and inspected and tested without affecting the attachment of the pieces of merchandise to each other.

8. The packaging system of claim 7 wherein the linear closure uses a one way ratchet mechanism.

9. A packaging system for displaying merchandise on a rack system having a rack member, comprising:

at least two pieces of merchandise for display together on the rack system;

reinforcing means secured in each of the at least two pieces of merchandise and adapted to provide at least one reinforced opening through each piece of the merchandise;

coupling means extending through the reinforced opening in each piece of merchandise, for securing the pieces of merchandise to each other and supporting the pieces of merchandise on the rack member wherein the coupling means is two closed loops;

whereby the at least two pieces of merchandise can be displayed on the rack system by hanging the coupling means on the rack member and the at least two pieces of merchandise can be removed from the rack member and inspected and tested without affecting the attachment of the pieces of merchandise to each other.

10. A packaging system for displaying merchandise on a rack system having a rack member, comprising:

at least two pieces of merchandise for display together on the rack system wherein the merchandise is a pair of gloves;

reinforcing means secured in each of the at least two pieces of merchandise and adapted to provide at least one reinforced opening through each piece of the merchandise;

coupling means extending through the reinforced opening in each piece of merchandise, for securing the pieces of merchandise to each other and supporting the pieces of merchandise on the rack member;

whereby the at least two pieces of merchandise can be displayed on the rack system by hanging the coupling means on the rack member and the at least two pieces of merchandise can be removed from the rack member and inspected and tested without affecting the attachment of the pieces of merchandise to each other.

11. A packaging system for displaying merchandise on a rack system having a rack member, comprising:

at least two pieces of merchandise for display together on the rack system wherein the merchandise is a pair of socks;

reinforcing means secured in each of the at least two pieces of merchandise and adapted to provide at least one reinforced opening through each piece of the merchandise;

coupling means extending through the reinforced opening in each piece of merchandise, for securing the pieces of merchandise to each other and supporting the pieces of merchandise on the rack member;

whereby the at least two pieces of merchandise can be displayed on the rack system by hanging the coupling means on the rack member and the at least two pieces of merchandise can be removed from the rack member and inspected and tested without affecting the attachment of the pieces of merchandise to each other.

12. A packaging system for displaying merchandise on a rack system having a rack member, comprising:

at least two pieces of merchandise for display together on the rack system wherein the merchandise is a pair of mittens;

reinforcing means secured in each of the at least two pieces of merchandise and adapted to provide at least one reinforced opening through each piece of the merchandise;

coupling means extending through the reinforced opening in each piece of merchandise, for securing the pieces of merchandise to each other and supporting the pieces of merchandise on the rack member;

whereby the at least two pieces of merchandise can be displayed on the rack system by hanging the coupling means on the rack member and the at least two pieces of merchandise can be removed from the rack member and inspected and tested without affecting the attachment of the pieces of merchandise to each other.

13. A packaging system for displaying merchandise on a rack system having a rack member, comprising:

at least two pieces of merchandise for display together on the rack system;

first reinforcing means secured in each of the least two pieces of merchandise and adapted to provide at least one reinforced opening through each piece of the merchandise;

support means for coupling the pieces of merchandise to the rack and for supporting the pieces of merchandise;

second reenforcing means secured in the support means and adapted to provide to at least one reinforced opening through the support means;

coupling means extending through the reinforced opening in each piece of merchandise and the support means for securing the pieces of merchandise to each other and to the support means;

whereby the at least two pieces of merchandise can be displayed on the rack system by hanging the supporting means on the rack member and the at least two pieces can be removed from the rack member with the supporting means and inspected and that tested without affecting the attachments of the pieces of merchandise to each other or the supporting means;

14. The packaging system of claim 13 wherein the first reinforcing means and the second reinforcing means are formed as grommets.

15. The packaging system of claim 13 wherein the merchandise has an edge and the first reinforcing means is positioned proximate to the edge.

16. The packaging system of claim 13 wherein the support means is a header member.

17. The packaging system of claim 13 wherein the support means is formed of cardboard.

18. The packaging system of claim 13 wherein the coupling means includes at least one closed loop.

19. The packaging system of claim 13 wherein the coupling means is formed from at least one linear closure.

20. The packaging system of claim 13 wherein the linear closure uses a one way ratchet mechanism.

21. The packaging system of claim 13 wherein the coupling means is formed of a plastic material.

22. The packaging system of claim 13 wherein the coupling means include two linear closures defining two separate closed loops through the first and second reinforcing means.

23. The packaging system of claim 13 wherein the merchandise is a pair of gloves.

24. The packaging system of claim 13 wherein the merchandise is a pair of socks.

25. The packaging system of claim 13 wherein the merchandise is a pair of mittens.

* * * * *